US005431558A

United States Patent [19]

McDonough et al.

[11] Patent Number: 5,431,558

[45] Date of Patent: Jul. 11, 1995

[54] SELECTIVELY ACTUATABLE LIGHTER

[75] Inventors: James M. McDonough, Guilford; Floyd B. Fairbanks, Naugatuck; Jean-Michel Monnier, Orange, all of Conn.

[73] Assignee: Bic Corporation, Milford, Conn.

[21] Appl. No.: 192,945

[22] Filed: Feb. 7, 1994

Related U.S. Application Data

[63] Continuation of Ser. No. 965,596, Oct. 23, 1992, abandoned, and a continuation-in-part of Ser. No. 912,421, Jul. 10, 1992, abandoned, which is a continuation of Ser. No. 609,668, Nov. 6, 1990, abandoned, said Ser. No. 965,596, is a continuation-in-part of Ser. No. 723,989, Jul. 1, 1991, which is a continuation-in-part of Ser. No. 609,668, Jul. 1, 1991, which is a continuation-in-part of Ser. No. 239,734, Sep. 2, 1988, Pat. No. 5,002,482.

[51] Int. Cl.[6] ..... F23D 11/36

[52] U.S. Cl. ..... 431/153; 431/255; 431/277; 222/153.14

[58] Field of Search ..... 431/344, 277, 254, 255, 431/256, 153; 222/153, 402.11

[56] References Cited

U.S. PATENT DOCUMENTS

| | | | |
|---|---|---|---|
| 1,895,032 | 1/1933 | Fisher | 431/255 X |
| 3,898,031 | 8/1975 | Rusakowicz | 431/153 X |
| 3,961,876 | 6/1976 | Chernock | 431/344 |
| 4,773,849 | 9/1988 | Schachter | 431/277 X |
| 4,921,420 | 5/1990 | Johnston | 431/344 X |
| 5,092,764 | 3/1992 | McDonough et al. | 222/153 X |
| 5,165,885 | 11/1992 | Iwahori | 431/276 X |
| 5,197,870 | 3/1993 | Yang | 431/153 |
| 5,213,495 | 5/1993 | Pan | 431/153 |
| 5,217,364 | 6/1993 | Frigiere | 431/344 |
| 5,217,365 | 6/1993 | Frigiere | 431/344 |

FOREIGN PATENT DOCUMENTS

| | | | |
|---|---|---|---|
| 0845002 | 8/1960 | United Kingdom | 431/277 |
| WO93/17282 | 9/1993 | WIPO . | |

*Primary Examiner*—Carl D. Price

*Attorney, Agent, or Firm*—Pennie & Edmonds

[57] ABSTRACT

A selectively actuatable lighter device is disclosed which includes a body defining reservoir for containing a combustible gaseous medium such as butane, and having a valve arranged to be selectively actuated between a normally closed position and an open position which permits the exit of the gaseous medium. Such lighter can selectively produce sparks at a location proximate to the gaseous medium exit to ignite the gaseous medium. Such lighter device embodies a resiliently releasable valve actuator which normally prevents actuation of the valve. The valve actuator includes an interfering portion which is selectively movable to a position out of interference with an interfering portion of the lighter body, so that the gaseous medium may be released and ignited by the sparks. Once the valve actuator is depressed and released, it returns to its closed or latched position to prevent actuation of the valve to the open position. To "re-use" the lighter, the valve actuator must again be moved to an unlatched position so that the valve can be actuated for subsequent ignition of the gaseous medium.

22 Claims, 6 Drawing Sheets

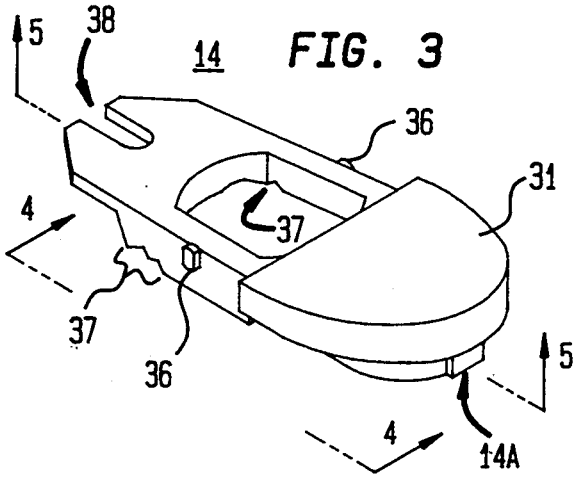
FIG. 3
FIG. 4
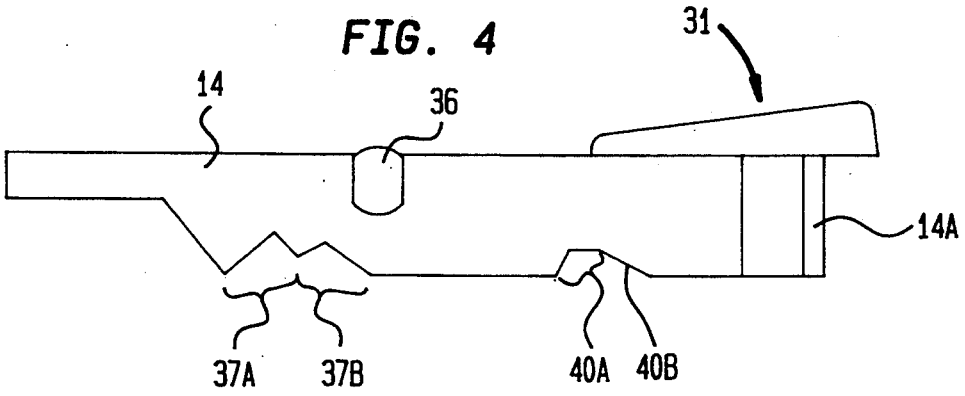
FIG. 5
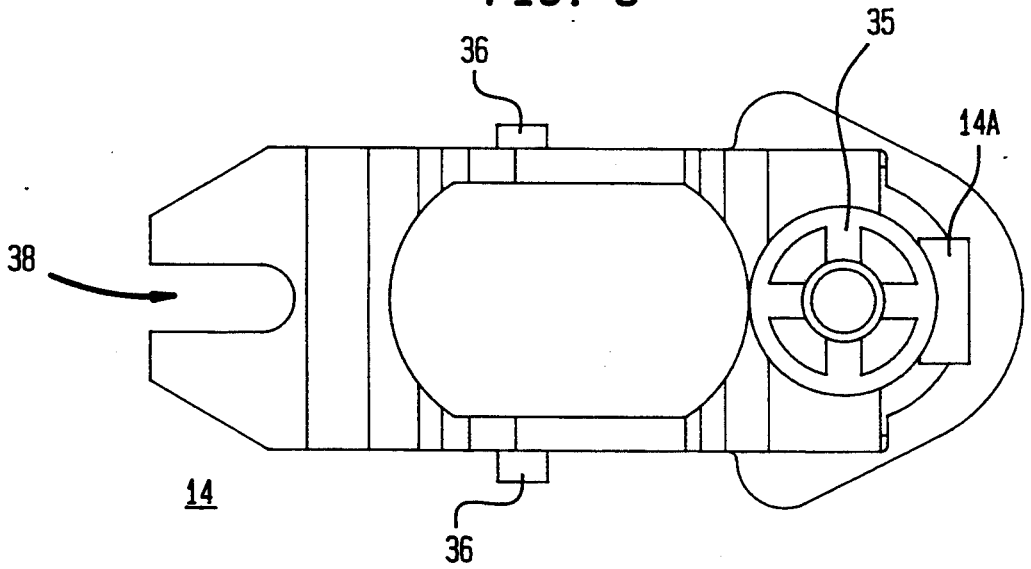

SELECTIVELY ACTUATABLE LIGHTER

CROSS-REFERENCE TO RELATED APPLICATIONS

This application is a continuation of U.S. patent application Ser. No. 07/965,596, filed Oct. 23, 1992, now abandoned, which is a continuation-in-part of U.S. patent application Ser. No. 07/723,989 filed on Jul. 1, 1991, entitled "Selectively Actuatable Lighter", which is a continuation-in-part of U.S. patent application Ser. No. 07/609,668 filed on Nov. 6, 1990, entitled "Selectively Actuatable Lighter", abandoned, which is a continuation of Ser. No. 07/239,734 filed on Sep. 2, 1988, entitled "Selectively Actuatable Lighter", which issued on Mar. 26, 1991 as U.S. Pat. No. 5,002,482. This is also a continuation-in-part of U.S. patent application Ser. No. 07/912,421, filed on Jul. 10, 1992, now abandoned, entitled "Selectively Actuatable Lighter", which is a continuation of U.S. patent application Ser. No. 07/609,668. Each of these four patent applications is incorporated herein by reference.

This application is also related to U.S. Pat. No. 5,125,829, entitled "Bidirectional Selectively Actuatable Lighter" which issued on Jun. 30, 1992, and U.S. Pat. No. 5,092,764, entitled "Selectively Actuatable Lighter With Locking Value Cap" which issued on Mar. 3, 1992. This application is also related to U.S. patent applications Ser. Nos. 07/965,958, 07/965,831 and 07/965,832, each entitled "Selectively Actuatable Lighter" and each filed concurrently herewith. Each of these two patents and three patent applications is incorporated herein by reference.

BACKGROUND OF THE INVENTION

Technical Field

This invention relates generally to lighters which consume fuel such as, for example, butane which is stored in a reservoir in a liquid state, then passed through a valve means and finally ignited by a spark or other similar means. More particularly, the invention relates to a butane cigarette lighter having a selectable configuration which prevents depression of a valve actuator and in turn hinders expulsion of fuel from a valve nozzle (i.e., fuel nozzle) and/or generation of sparks thereby rendering operation of the lighter by young children even more difficult. Advantageously, this feature of the lighter may be deactivated by moving a valve actuator to a non-interfering position, thus facilitating flame production.

Description of the Art

Numerous lighters are known, some of them incorporating features which are designed to render operation of the lighter more difficult by certain users. Some of such features relate to mechanisms which are designed to prevent ignition of a fuel source unless the lighter is properly oriented, mechanisms which are designed to automatically turn off a fuel source supply valve, and tamper protection arrangements.

More recently, attention has been directed toward preventing ready actuation of such lighters by persons normally not able to appreciate the potential danger of the flame. Individuals normally contemplated in these efforts are young children, in the age category younger than five years.

U.S. Pat. No. 4,784,601 to Nitta relates to a gas lighter having an L-shaped slideable stopper which is positionable to prevent descent of a gas lever which controls fuel flow. The lighter is rendered operable by moving the stopper outward so that its vertical leg is displaced from the top surface of the lighter housing. The L-shaped slideable stopper must be manually moved into its locking position each time it is desired to lock the lighter.

U.S. Pat. No. 4,784,602 to Nitta relates to a gas lighter having an L-shaped slideable stopper which is positionable to prevent descent of a gas lever which controls fuel flow. The lighter is rendered operable by moving the stopper inward so that its vertical pin engages a hole in the surface of the lighter housing. The L-shaped slideable stopper must be manually moved into its locking position each time it is desired to lock the lighter.

U.S. Pat. No. 4,786,248 to Nitta relates to a piezoelectric lighter equipped with a thumb-latch slideably fitted within a lighter casing. The thumb latch is manually slideable into and out of a position which interferes with depression of a thumb-pusher. The lighter is rendered operable by manually sliding the thumb-latch to an unlocked position. After operation of the lighter a user must manually slide the thumb-latch to its locked position in order to lock the lighter.

U.S. Pat. No. 4,904,180 to Nitta relates to a piezoelectric lighter equipped with a lock means which automatically returns to a locked position after use of the lighter. The lock means includes a stopper and a leaf-spring which keeps the stopper urged toward the windshield. The lighter may only be operated after the stopper is drawn backwards, away from the windshield. The lighter cannot maintain the stopper in the drawn back position without the application of constant force by a user. That is, no means are provided to maintain the lighter in an unlocked configuration.

U.S. Pat. No. 1,895,032 to Fisher relates to a lighter in which a manual control means is movable out of engagement with a shoulder portion of the lighter so as to enable the manual control means to be depressed thereby causing the lighter to operate. The control means returns to its position in engagement with the shoulder portion after use of the lighter. The lighter cannot maintain the control means in its out of engagement position without the application of constant force by a user.

U.S. Pat. No. 4,830,603 to Cirami relates to a cigarette lighter in which a locking mechanism is provided partially under a valve-actuating push-button and extends into a compartment appended to but distinct from a fuel compartment. The locking mechanism relocks itself after each depression of the push-button. In particular, one end of a stiffly flexible spring steel wire is held firmly in place in the compartment. Another end of the spring steel wire forms a probe extending into a channel provided in the underside of the push-button. The spring steel wire, in a locked configuration, prevents depression of the push-button by engaging a-low ceiling on the underside of the push-button. A portion of the spring steel wire in the form of a loop extending outward from the lighter is accessible by an operator and may be suitably moved by the operator thereby causing the probe to move within the channel in the underside of the push-button.

U.S. Pat. No. 4,832,596 to Morris, Sr. relates to a cigarette lighter having a stop member slideably mounted thereon for releasably engaging a gas valve actuating lever. In particular, a spring biased stop member is slideably mounted on a top portion of a conventional disposable cigarette lighter. The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby causing the fuel to ignite and operating the lighter. Rotation of the spark-producing wheel in the other direction may deliver a spark away from the nozzle. The spark-producing wheel has a pin-shaped structure attached thereto which serves to limit the rotation of the wheel to under 360° by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which partially surround a spark-producing wheel, fuel nozzle or depressible valve actuation member of a lighter. These presale tamper protection mechanisms are attached to the lighter housing by frangible webs and are removed by a purchaser after sale of the lighter to expose the spark-producing wheel, fuel nozzle and/or depressible valve actuation member. However, such a presale tamper protection mechanism is of limited value once initially removed by a purchaser.

U.S. Pat. Nos. 3,547,566 to Tamarin and 3,899,286 to Lockwood et al. relate to lighters having orientation sensing mechanisms which hinder or prevent actuation of the lighter in an inverted position. Unfortunately, such mechanisms may not provide a sufficient degree of child resistancy to young children who tamper with the lighter since they merely hinder operation in prescribed orientations.

U.S. Pat. No. 4,921,420 to Johnston relates to a disposable lighter having a release means that is physically separated from the conventional lighting means. The lighter may only be operated once the release means is released. The distance separating the release means and the conventional lighting means is intended to be sufficiently large so as to make it difficult for small children to operate the lighter.

U.S. Pat. No. 5,074,781 to Fujita relates to a cigarette lighter having a lock member which must be rotated in a specified direction towards one side of the lighter so as to allow a depressible valve actuator to be depressed and the lighter to operate.

U.S. Pat. No. 5,076,783 to Fremund relates to a lighter having a depressible valve actuator which is coupled to a vertical rod which extends to an opposite end of the lighter where it contacts a locking member. The locking member must first be displaced so as to enable depression of the valve actuator.

U.S. Pat. No. 5,090,893 to Floriot relates to a lighter having a slide member which, when in a first position, prevents depression of a valve actuator. The slide member is slideably movable to a second position in which the valve actuator may be depressed. The slide member is not capable of vertical movement. Additionally, the slide member protrudes from the lighter when in its first position.

Many mechanisms which are designed to render operation of the lighter more difficult by certain users are unnecessarily complicated, present difficulty in their manufacture, exhibit a high likelihood of mechanical failure during use and/or require that additional components be incorporated into the lighter.

For example, the particular construction employed by some devices limits the shape and size of the lighter housing due to the requirement that the housing be large enough to accommodate such mechanism(s). Some mechanisms may be defeated with relative ease while some devices are not sufficiently reliable. For example, some mechanisms may be overridden or removed with relative ease. Some devices are not equally adaptable for use by both right-handed and left-handed users, and some include inconveniently shaped or positioned levers or knobs which need to be actuated by the user in order to operate the lighter. Some devices require that a user manually lock the lighter after its use. Furthermore, some of these devices require repositioning of the lighter in an operator's hand after actuation of the mechanism and before the lighter is operated to produce a flame. For example, some lighters include an actuatable mechanism located sufficiently far from a valve actuation means, or on another side of the lighter than the valve actuation means, so as to result in awkward operation of the lighter.

As will be appreciated, development of a "child-proof" lighter per se is probably not viable. At best, it can be reasonably sought to create a lighter having features which enhance its child-resistant capability, but how "child-resistant" a lighter will be will depend upon many factors and circumstances. Nevertheless, any lighter having features which enhance its child-resistant capability will have limitations with respect to young children, and no such lighter should provide parents or adults with a false sense of security so that they may become less cautious in their handling of the lighter or permit access to the lighter by young children. Further, such lighters should not be made so difficult to light as to cause adults to use alternative forms of lighting, i.e., matches, which are generally considered to be potentially more dangerous.

The present invention is directed toward a reliable flame producing lighter which is selectively actuatable in such a manner as to provide a substantial degree of difficulty for young children—younger than five years—to actuate the lighter and produce a flame, while being user friendly and capable of actuation by adults.

SUMMARY OF THE INVENTION

This invention relates to a selectively actuatable flame producing lighter having a valve actuator which is normally in a latched position and which is movable to an unlatched or non-interfering position in which the lighter may be operated. More specifically, the valve actuator is slideable inward from its latched position in which it cannot be depressed, to its unlatched position in which it can be depressed thus enabling fuel to flow. The valve actuator may be retained in its latched and unlatched positions without the application of any user applied force. Once the valve actuator is moved to its unlatched position, depression and release of the valve actuator results in the valve actuator returning to its latched position.

Advantageously, the lighter of the present invention does not require the incorporation of additional components. Additionally, the valve actuator of the lighter is movable from its latched position to its unlatched position with the same finger a user employs to depress the valve actuator, without requiring repositioning of the lighter in a user's hand. The lighter is adapted for use by right-handed as well as left-handed users with the same relative ease. The lighter is preferably similarly actuated by both right-handed and left-handed users, without detracting from the effectiveness of the lighter's child-resistant capability. That is, the valve actuator is preferably movable along only a single path from its latched position to its unlatched position, whether operated by right-handed or left-handed users.

One particular embodiment of the invention relates to an improved lighter of the type having a housing, valve means for selectively releasing fuel and means for igniting the fuel, wherein the improvement comprises a depressible valve actuator movable from a first position in which it is incapable of being depressed to a second position in which it is capable of being depressed thereby enabling operation of the lighter.

Preferably, the second position is inward of the first position, and the valve actuator is retained in the second position without the application of an external force. Additionally, the valve actuator automatically returns to its first position after depression and release of the valve actuator. The valve actuator is movable along only a single path from its first position to its second position, the single path being equally suitable for right-handed as well as left-handed users.

The preferred embodiment of the lighter further comprises camming means for camming the valve actuator outward toward its first position as the valve actuator is depressed in its second position. The lighter also includes an interfering portion which prevents depression of the valve actuator when in the first position. Preferably, the valve actuator includes a first mating structure and the lighter includes a second mating structure, the second mating structure applying a biasing force to the first mating structure after the valve actuator is depressed and released, the biasing force biasing the valve actuator outward toward its first position.

The means for igniting the fuel may comprise flint material and a rotatable spark-producing wheel having a toothed surface positioned and arranged to selectively frictionally contact the flint material. Alternatively, the means for igniting the fuel comprises electric spark-producing means such as piezoelectric spark-producing means.

Another embodiment of the invention relates to a flame producing lighter resistant to unauthorized use and normally maintained in a latched configuration which comprises a housing; fuel supply means for supplying fuel to be ignited; ignition means for igniting the fuel; valve means for controlling the flow of fuel; and a valve actuator which normally prevents the flow of fuel and which is depressible so as to permit fuel to flow out from the fuel supply means, the valve actuator being depressible only after it has been moved to a non-interfering position. In this embodiment, inward movement of the valve actuator to its non-interfering position enables an interfering portion of the valve actuator to move out of alignment with an interfering portion of the housing so as to enable the valve actuator to be depressed.

The present invention also relates to an improved lighter of the type having valve means for selectively releasing fuel, means for igniting the fuel, valve actuator means for actuating the valve means so as to release fuel, the valve means including a fuel nozzle which expels fuel when the fuel nozzle is lifted upward by the valve actuator means, wherein the improvement comprises a compensator spring which maintains the fuel nozzle in its downward position when the value actuator is initially actuated. The compensator spring is preferably positioned between the valve actuator means and a portion of the fuel nozzle so as to urge the fuel nozzle downward. The compensator spring is preferably a metallic coiled spring. The fuel nozzle is preferably normally biased downward by the valve actuator means.

In another embodiment, such lighter includes interference means positioned so as to normally interfere with actuation of the valve actuator means, and the compensator spring means compensates for movement of the valve actuator means when the interference means is normally positioned so as to interfere with the actuation of the valve actuator means.

Operation of the lighter requires a certain amount of dexterity and the application of concentrated forces as well as the application of a plurality of forces in multiple directions and in a specified sequence. Additionally, operation of the lighter requires a certain level of cognitive ability.

Advantageously, the lighter of the present invention does not require the incorporation of additional components in order to provide its latching/unlatching feature.

Furthermore, the lighter of the present invention is a passive latching lighter. Advantageously, the lighter automatically returns to its latched configuration once the depressed valve actuator is released. Thus, the lighter is maintained in an at-rest or default configuration which is latched thereby preventing the flow of fuel and the production of a flame.

The lighter is adapted for use by right-handed as well as left-handed users with the same relative ease, and is similarly actuated by both right-handed and left-handed users. Furthermore, the user may operate the latch mechanism with the same finger as used to depress the valve actuator without requiring the user to reposition the lighter in the user's hand.

BRIEF DESCRIPTION OF THE DRAWINGS

These and other objects, features, and advantages of the present invention will become more readily apparent from the following detailed description of the invention in which:

FIG. 3 is a perspective view of the valve actuator depicted in FIGS. 1 and 2;

FIG. 4 is a side view of the valve actuator depicted in FIG. 3;

FIG. 5 is a bottom view of the valve actuator depicted in FIG. 3;

DETAILED DESCRIPTION OF THE PREFERRED EMBODIMENT

Figure 1:
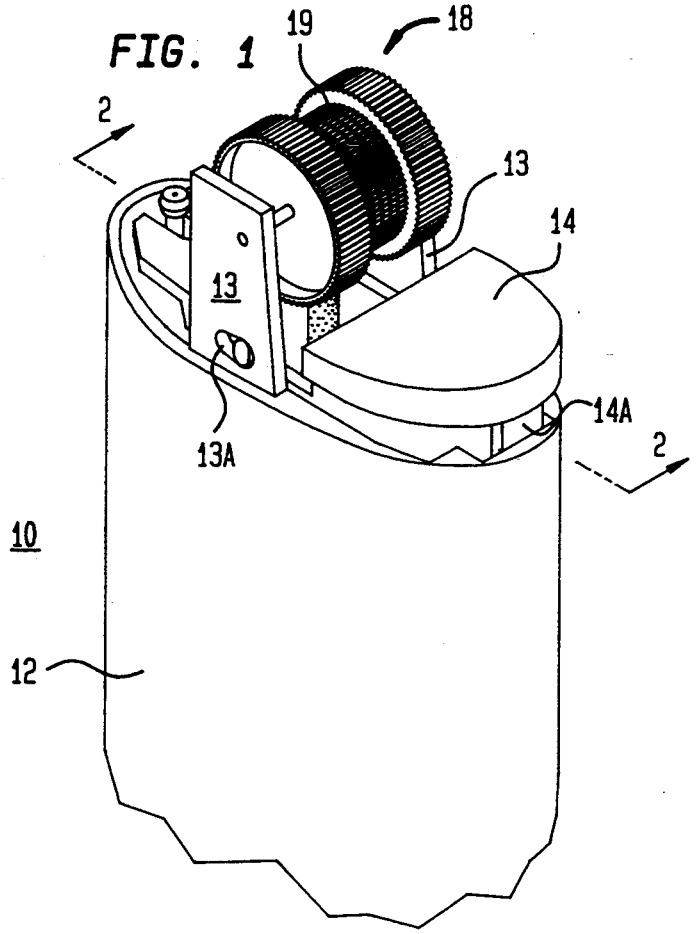
FIG. 1 is a partial perspective view of a preferred embodiment of a selectively actuatable lighter of the present invention in a latched configuration.

Referring initially to FIG. 1, there is depicted, in a default or at-rest configuration, the lighter 10 of the present invention comprising a main body portion 12, a depressible valve actuator 14, and a spark-producing wheel assembly 18 which includes a toothed surface 19. Advantageously, the default configuration is also a latched configuration in which valve actuator 14 is in its latched position and thus cannot be depressed. Illustratively, interference presented by an interfering portion (not shown) of housing 12 prevents depression of the valve actuator when it is in its latched position. Depression of valve actuator 14 permits fuel to flow through a fuel nozzle and to be ignited by sparks produced by toothed surface 19 of spark-producing wheel assembly 18 frictionally engaging a flint. Advantageously, unless valve actuator 14 is positioned away from its depicted at-rest or default position and into a non-interfering position, any attempted depression of valve actuator 14 will not result in the flow of fuel and the lighter will be inoperable. The position of valve actuator 14 as shown in FIGS. 1 and 2 may best be characterized as a "default position" under normal conditions.

As will be appreciated, a variety of configurations, shapes and relative positioning exists for the valve actuator and the housing on which the valve actuator is movable between an interfering or latched position and a non-interfering or unlatched position. The invention will be described in terms of a preferred embodiment in which the valve actuator cannot be depressed when in its latched position, but can be depressed after it is moved to an unlatched position. Illustratively, movement of the valve actuator from its latched position to its unlatched position comprises generally slideable inward movement of the valve actuator. As will be appreciated, for ease of understanding, such inward motion of the valve actuator is deemed to include any inward motion or component thereof of any portion of the valve actuator. The valve actuator is preferably maintained in its unlatched position after being moved there by a user, and preferably automatically returns to its latched position once a user depresses and releases the valve actuator.

A user typically holds the main body portion of a conventional lighter in his hand, rotates with his thumb the spark-producing wheel in a direction generally toward the depressible surface of the valve actuator to produce a spark, and depresses the valve actuator to allow fuel to pass through the fuel, or valve, nozzle. The spark produced by the wheel ignites the fuel. This is a relatively conventional structure for most lighters, including disposable lighters.

Figure 2:
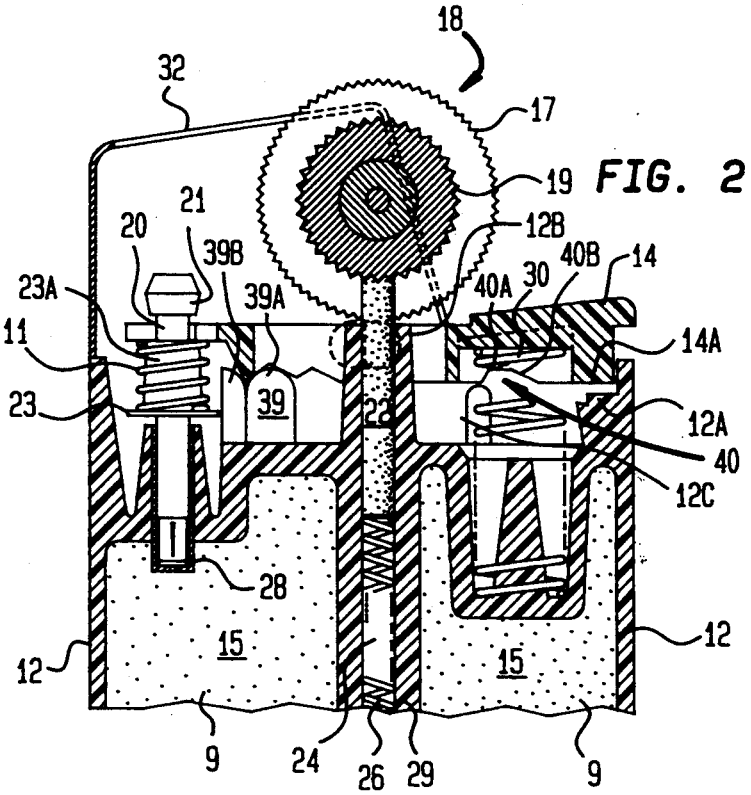
FIG. 2 is a partial cross-sectional view of the lighter of FIG. 1 depicting the valve actuator in a latched configuration.

Referring now to FIG. 2, there is depicted a cross-section of the lighter of FIG. 1 in a latched configuration. More particularly, valve actuator 14 is mounted between side wall portions 13 (see FIG. 1) which illustratively comprise extensions of the side walls of body portion 12. Illustratively, valve actuator 14 is pivotally mounted to sidewall portions 13. Advantageously, an elongated bore 13A (FIG. 1) is formed in each of sidewall portions 13 to accept extensions of the valve actuator, thus enabling pivotal movement of the valve actuator about the bores as well as slideable movement of the valve actuator in inward and outward directions. Bores 13A can take on a variety of shapes, such as an elongated bores having curve-shaped portions in which case sliding the valve actuator within the bores would result in upward and/or downward movement of the valve actuator extensions. As will be appreciated, bores 13A limit the movement of the valve actuator. Valve actuator 14 is attached to hollow fuel nozzle 20 slideably supported within a valve housing 28. Hollow fuel nozzle 20 is held within an opening such as a slot in valve actuator 14 by flange 21, compensator spring means 11 and flange extension 23A. Flange 21 and flange extension 23A each has a sufficient size and is configured so as to prevent slippage of nozzle 20 through the slot in valve actuator 14. Additionally, spring means 11 is maintained as shown in FIG. 2 by flange 23 which is attached to fuel nozzle 20 as is flange 21. A compressed spring means 30 resides beneath valve actuator 14 and causes fuel nozzle 20 to be urged downward into valve housing 28 and body portion 12. In particular, compressed spring 30 causes valve actuator 14 to apply force to spring means 11 which supplies force to flange 23, thereby urging nozzle 20 downward into valve housing 28 and body portion 12 and preventing the flow of fuel through nozzle 20. Additionally, downward movement of valve actuator 14 in the vicinity of nozzle 20 is limited by contact between the underside of valve actuator 14 and flange extension 23A. In such an embodiment, valve actuator 14 is employed to lift nozzle 20 by the application of force to flange 21 in order to expel fuel. A valve assembly (not fully shown) is located near the recessed end of nozzle 20 and permits fuel to flow through nozzle 20 only when valve actuator 14 is depressed and nozzle 20 lifted.

As will be appreciated, actuation of valve actuator 14 generally results in upward movement of the valve actuator in the vicinity of nozzle 20. However, in the embodiment depicted in FIG. 2, nozzle 20 remains downward during the initial upward movement of valve actuator 14 in the vicinity of nozzle 20 due to the action of compensator spring 11. More specifically, nozzle 20 only moves upward once the valve actuator in the vicinity of nozzle 20 moves upward a sufficient amount such that a top surface of valve actuator 14 in the vicinity of nozzle 20 contacts flange 21. Advantageously, depression of the valve actuator while the lighter is in a latched configuration, while possibly causing the valve actuator in the vicinity of nozzle 20 to move upward due to, for example, a gap between valve actuator interfering portion 14A and housing interfering portion 12A, will not result in any upward movement of the fuel nozzle. Accordingly, fuel will not be released in the event the valve actuator is depressed while the lighter is in a latched configuration. As will be appreciated, such use of a compensator spring is desirable in lighters which incorporate a gap allowing some depression of a latched valve actuator which would otherwise release fuel due to such depression.

Lighter 10 further comprises a sparking flint 22 mounted within a bore 24 defined by flint and spring housing 29 in main body 12. Flint 22 is urged toward toothed surface 19 of wheel assembly 18 by spring 26. Spark-producing wheel assembly 18, which includes toothed surface 19 which is preferably suitably hardened and against which flint 22 is urged, is mounted for rotation between side wall extension portions 13 in a conventional manner. Toothed surface 19 includes suitable indentations which define teeth such that when spark-producing wheel assembly 18 is rotated toothed surface 19 cuts against flint 22 causing the generation of ignition sparks. Additionally, spark-producing wheel assembly 18 includes suitable indentations 17 which facilitate rotation of spark-producing wheel assembly 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material or materials, and is preferably constructed from a plastic material. A shield 32, preferably constructed from metal, is provided and functions as a wind guard around the flame thereby assisting in the ignition of the fuel.

As will be appreciated, main body 12 generally encompasses any part, portion, structure or substructure of the lighter except for the valve actuator and spring, spark-producing wheel assembly, flint and spring, and valve means. Accordingly, what will be described as housing interfering portion 12A is deemed to include any such part, portion, etc.

Referring again to FIG. 2, valve actuator 14 is depicted in its latched configuration in which an interfering portion 12A of housing 12 is positioned and configured so as to interfere with and prevent depression of valve actuator 14. More specifically, an interfering portion 14A of valve actuator 14 contacts interfering portion 12A of housing 12 upon attempted depression of valve actuator 14, thereby preventing actuation of the valve means and thus the release of fuel. As will be discussed in conjunction with FIGS. 10–14, valve actuator 14 is movable inward until the extensions of valve actuator 14 reach their limit of travel within bores 13A. Additionally, at such an inward position, valve actuator stop portion 14B preferably contacts camming means 12B which is illustratively formed in housing 12. At such inward position, valve actuator interfering portion 14A is no longer aligned with housing interfering portion 12A thus enabling depression of valve actuator 14 and sufficient downward movement of valve actuator interfering portion 14A so as to cause the valve actuator to lift fuel nozzle 20. A user desiring to actuate the lighter must first force valve actuator interfering portion 14A out of interference with housing interfering portion 12B. This is accomplished by a user moving valve actuator 14 inward such that interfering portion 14A is moved out of alignment with interfering portion 12A. As will be discussed in conjunction with FIGS. 10–14, once a user moves valve actuator 14 sufficiently inward, the valve actuator will remain inward in its unlatched position until a user depresses and releases the valve actuator.

Referring now to FIG. 3, there is depicted valve actuator 14 in greater detail. Valve actuator 14 comprises a finger depressible surface 31, extensions 36, nozzle opening 38, and valve actuator mating structure 37. Such mating structure illustratively comprises two indentations formed on each of two halves of the valve actuator. Extensions 36 are provided to matingly engage with elongated bores 13A in side wall portions 13 of body portion 12 to provide pivotal movement of the valve actuator about extensions 36 as well as slideable movement of the valve actuator within bores 13A. Nozzle opening 38 is adapted for receiving and grasping a portion of fuel nozzle 20 between flanges 21 and 23.

Valve actuator 14 is constructed from material having sufficient dimensional stability and rigidity to continuously over the life of the lighter assure proper relative positioning between interfering portion 14A of valve actuator 14 and interfering portion 12A of housing 12. Actuator 14 is preferably constructed from zinc or glass-filled polyetherimide. Other illustrative materials from which valve actuator 14 may be constructed are aluminum and other glass filled polymers such as polyethersulfone or the like, as well as combinations of these materials.

Referring back to FIG. 2, the lighter is provided with mating structure 39. Such mating structure is shaped, configured, positioned and adapted to mate with valve actuator mating structure 37. Preferably, such mating structure 39 is immobile with respect to housing 12 and illustratively comprises two protrusions, 39A and 39B.

As will be appreciated, mating structures 37 and 39 may take on a variety of shapes, positions and configurations. Their specific structure is not critical to the present invention. Additionally, each of structures 37 and 39 can comprise any reasonable number of separate structures. As will also be appreciated, the interaction between mating structures 37 and 39 facilitates retention of the lighter in its latched as well as unlatched configuration.

FIG. 4 is a side view of the valve actuator of FIG. 3, depicting indentations 37A and 37B of valve actuator mating structure 37, as well as valve actuator interfering portion 14A. Additionally, FIG. 4 depicts valve actuator mating structure 40. Such mating structure illustratively comprises two portions 40A and 40B.

Referring now to FIG. 5, there is depicted a view of the underside of valve actuator 14 of FIG. 3. A portion 35 of valve actuator 14 is adapted to receive spring 30 as depicted in FIG. 2 and may take on a variety of forms such as a protruding member or, alternatively, an indentation or bore partially into valve actuator 14. The fuel nozzle is illustratively maintained in nozzle opening 38 by fuel nozzle flanges 21 and 23 and spring means 11 (FIG. 2) which have a diameter greater than the width of nozzle opening 38.

Figure 6:
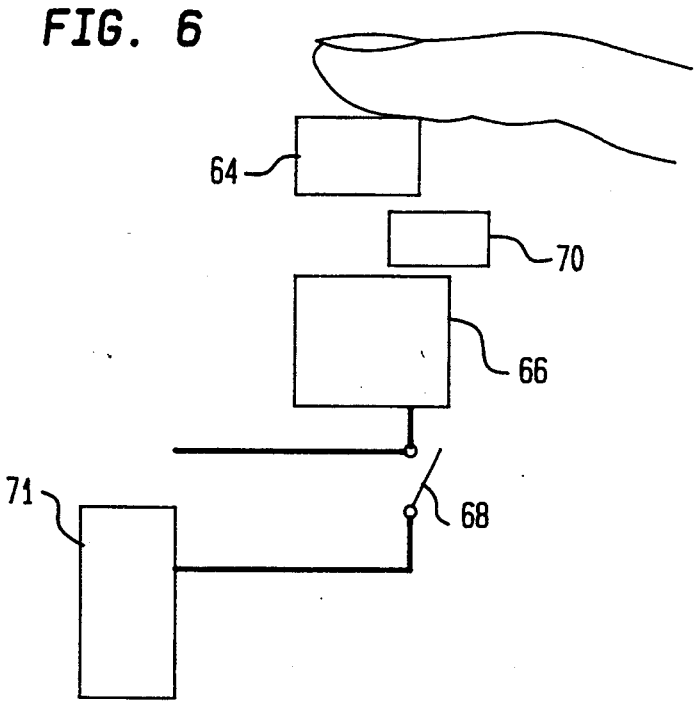
FIG. 6 is a schematic diagram depicting a piezoelectric lighter apparatus in which the present invention may be employed and having an optional switch depicted in the open position, an interfering means, and a hammer/fuel release means depicted in the latched position to prevent the production of sparks and the flow of fuel.

FIG. 6 schematically depicts a piezoelectric type lighter in which the present invention may be employed. The piezoelectric lighter comprises hammer and fuel release means 64, spark providing means 66, optional electrical cut-off switch 68, interfering means 70 and valve means 71. The piezoelectric lighter operates in a conventional manner except for depression of hammer means 64 which is normally prevented by inclusion of interfering means 70 operative in accordance with the present invention. Illustratively, such hammer means 64 comprises an actuator which prevents the production of sparks. In particular, the actuator may prevent the production of sparks by electrically and/or mechanically isolating an energy source from the spark producing means. Alternatively, the actuator may be arranged to selectively prevent only the flow of fuel or it may be arranged to selectively prevent both the production of sparks and the flow of fuel. As depicted in FIG. 6, the lighter is in a latched configuration since hammer means 64 is positioned relative to interfering means 70 so as to prevent actuation of hammer means 64. Additionally, optional switch 68 is depicted in an open, or off, position.

Figure 7:
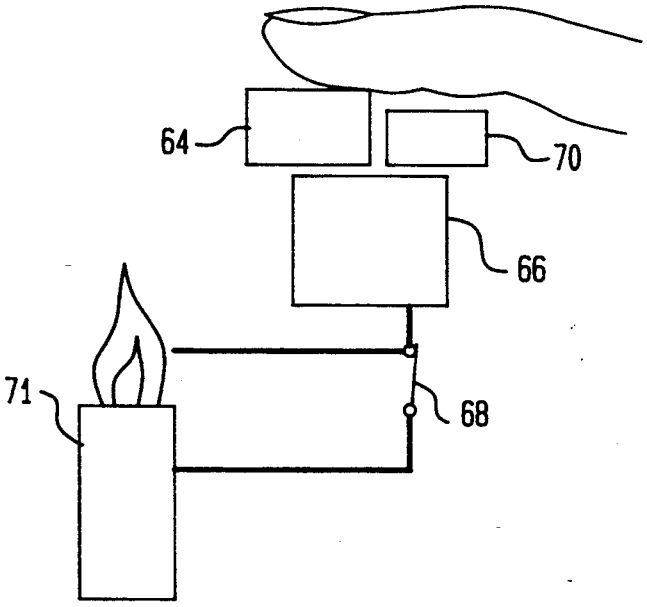
FIG. 7 is a schematic diagram depicting the piezoelectric lighter of FIG. 6 with the switch depicted in the closed position and the hammer/fuel release means depicted in the unlatched position and depicting a flame.

FIG. 7 schematically depicts the piezoelectric type lighter of FIG. 6 in an unlatched configuration. In particular, hammer means 64 is positioned relative to interfering means 70 so as to enable actuation of hammer means 64. Additionally, switch 68 is depicted in a closed, or on, position. As will be appreciated, incorporation of optional switch 68 requires that it be closed and that hammer means 64 be unlatched in order for fuel to be ignited.

Advantageously, the present invention automatically returns the valve actuator to its latched position after the lighter has been activated and, in particular, after the valve actuator has been depressed and released. The interaction between valve actuator mating structure 37 and housing mating structure 39 facilitates such automatic return, as does camming means 12B which is depicted in FIGS. 2 and 10–14.

Figure 8:
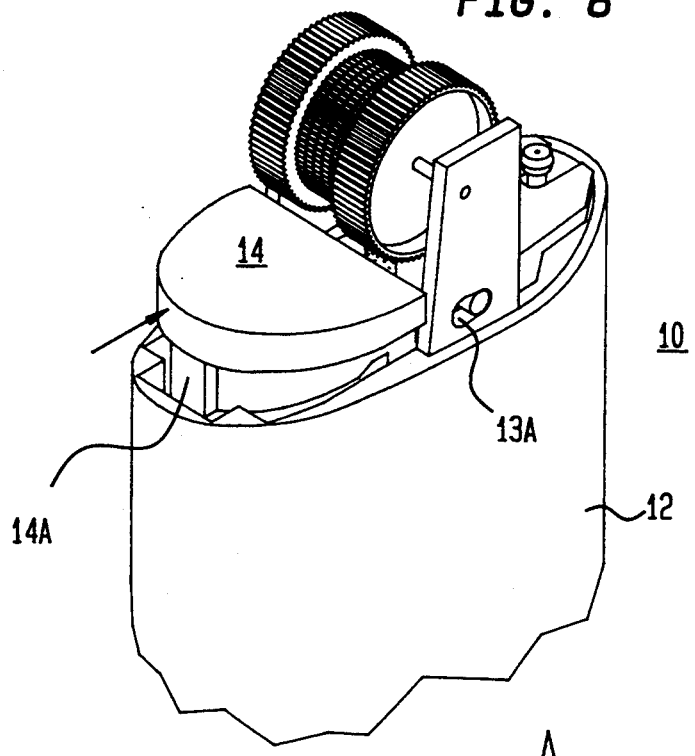
FIG. 8 is a perspective view of a preferred embodiment of the lighter in an unlatched configuration in which the valve actuator is at its unlatched position thereby permitting depression of the valve actuator so as to permit a valve to open and gas to be released through a fuel nozzle.
Figure 9:
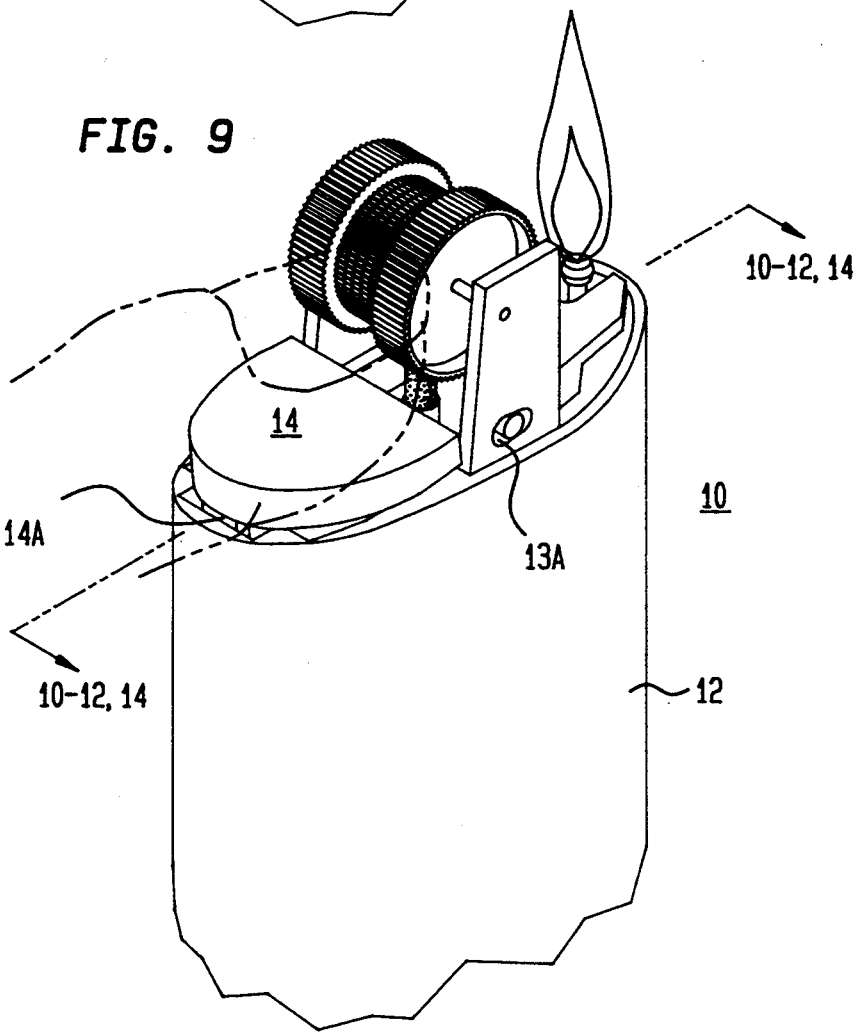
FIG. 9 is a perspective view of the lighter of FIG. 8 with the valve actuator in a depressed position and the valve open and depicting a flame.

In operation of the present invention, and as depicted in FIGS. 1, 8 and 9, a user must first move valve actuator 14 in an inward direction (FIG. 8) so as to sufficiently displace interfering portion 14A of valve actuator 14 out of interference with interfering portion 12A of housing 12 (FIG. 2) so as to ultimately permit depression of valve actuator 14 and downward movement of the actuator. In order to facilitate retention of valve actuator 14 in a non-interfering position, valve actuator 14 must be displaced sufficiently inward as will be described in more detail in conjunction with FIG. 11.

Additionally, once the valve actuator is displaced sufficiently inward, valve actuator stop portion 14B will abut or approximately abut camming means 12B, and valve actuator extensions 36 will reach their limit of travel as defined by bores 13A, as best seen in FIG. 2. Accordingly, camming means 12B may also function as a stop member to limit the inward movement of valve actuator 14 and provide feedback to a user. As will be appreciated, other components or portions may be employed to limit inward movement of the valve actuator. Such displacement of valve actuator 14 places the lighter in an unlatched configuration as depicted in FIG. 8. Depression of valve actuator 14 at this point and suitable rotation of the spark-producing wheel assembly 18 will cause the lighter to operate, and will also cause part of valve actuator 14 to travel downward as indicated in FIG. 9. In particular, the sparks thus produced will ignite the gaseous fuel which is permitted to be expelled from the fuel nozzle when valve actuator 14 lifts the nozzle thereby actuating the valve. The lifting action of valve actuator 14 in a vicinity near the nozzle releases fuel from the fuel chamber thereby permitting the flow of fuel as a gaseous medium through the nozzle and the subsequent burning of such fuel.

Additionally, depression of surface 31 of valve actuator 14 causes the valve actuator to move outward toward its latched position. More specifically, as the valve actuator is urged downward, valve actuator stop portion 14B is urged downward and against camming means 12B which forces valve actuator 14 outward. The outward movement of valve actuator 14 from its unlatched position (see FIGS. 5, 8–9) to its latched position (see FIG. 1), in the preferred embodiment, may generally be considered to be initially due to camming means 12B which serves to displace valve actuator mating structure 37 relative to structure 39, and then due to forces exerted by structure 39 onto structure 37 as surface 31 of valve actuator 14 moves upward.

Thus, the presently preferred embodiment of the invention may be placed in an unlatched configuration from its default latched configuration by sufficiently displacing valve actuator interfering portion 14A relative to interfering portion 12A. This may be accomplished by sliding valve actuator 14 fully inward.

Figure 10:
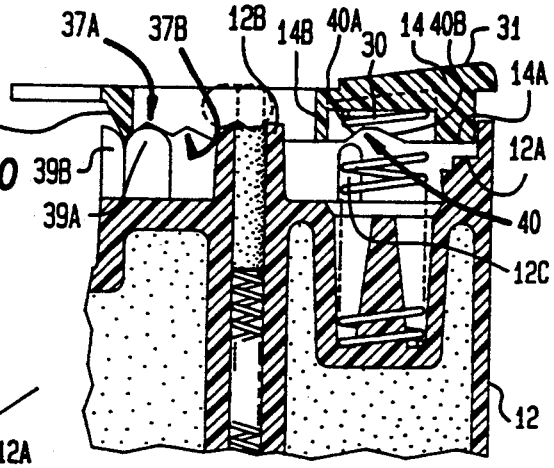
FIG. 10 is a partial cross-sectional view of the preferred embodiment of the lighter in its latched configuration thereby preventing depression and actuation of the valve actuator.

FIGS. 10–14 depict the sequence of operations required for the unlatching of the lighter by positioning valve actuator interfering portion 14A out of alignment with interfering portion 12A. In particular, FIG. 10 depicts valve actuator 14 in the default or latched position. As will be appreciated, each of FIGS. 1 and 10 depict the valve actuator in the same latched position. In this position, depression of valve actuator 14 by finger pressure on surface 31 is prevented by the contact between interfering portion 14A of valve actuator 14 and interfering portion 12A housing 12. As depicted in FIG. 10, valve actuator 14 is prevented from any further downward movement since interfering portion 14A of valve actuator 14 abuts interfering portion 12A of body 12, except for a small gap thereinbetween. For ease of illustration, the gap between portions 14A and 12A in the Figures is not necessarily drawn to scale. Additionally, such a gap is not necessary for proper operation of the invention.

Figure 11:
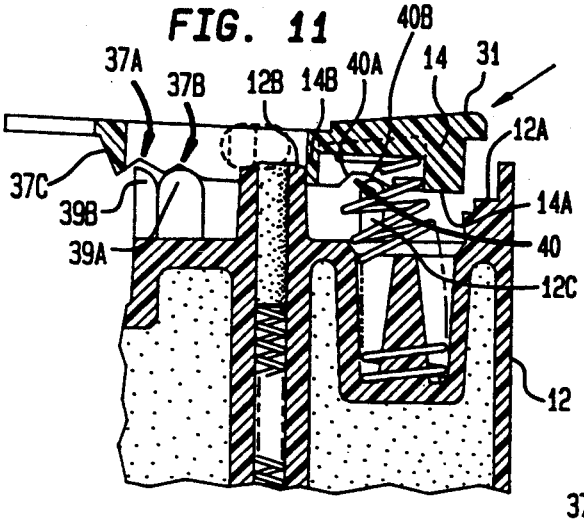
FIG. 11 is a partial cross-sectional view of the lighter of FIG. 10 in its unlatched configuration and the valve actuator not depressed and the lighter ready for actuation.

Additionally, movement of the valve actuator inward to its unlatched position of FIG. 11 typically results in some downward movement of the valve actuator and, more specifically, downward movement of valve actuator depressible surface 31. For this reason, a small gap between portions 14A and 12A may be desirable when the lighter is latched. However, it will be appreciated that alternative shapes for bore 13A could result in no downward movement of the valve actuator depressible surface as it is moved inward.

Referring again to FIG. 10, valve actuator mating structure 37 contacts housing mating structure 39 when the valve actuator is in its depicted latched position due to the force exerted by spring 30 on valve actuator 14. More specifically, indentation 37A of valve actuator mating structure 37 engages protrusion 39A of housing mating structure 39. As will be appreciated, movement of valve actuator 14 inward or outward from its depicted latched position would initially force the portion of valve actuator 14 in the vicinity of structure 37 to move upward thereby causing spring 30 to compress further. Accordingly, absent the application of any external force, the lighter maintains the latched configuration of FIG. 10. Additionally, any outward movement of the latched valve actuator is prevented by valve actuator extensions 36 having reached their outward limit of travel within bores 13A, as best seen in FIG. 1.

FIG. 10 also depicts camming means 12C which is illustratively formed within housing 12 as two protusions, one on each side of spring 30. As seen in FIG. 10, valve actuator mating structure 40 is positioned to the right of, and above, camming means 12C. As will be appreciated, camming means 12C and valve actuator mating structure 40 may take on a variety of shapes, positions and configurations. Their specific structure is not critical to the present invention. Additionally, each of camming means 12C and mating structure 40 can comprise any reasonable number of separate parts or elements. As will be appreciated, camming means 12C and mating structure 40 are not necessary for proper operation of the invention as their function could be performed solely by camming means 12B and valve actuator stop portion 14B.

FIG. 11 depicts valve actuator 14 moved inward into its unlatched position and ready for depression. As will be appreciated, each of FIGS. 8 and 11 depict the valve actuator in the same unlatched position. Valve actuator 14 including its interfering portion 14A have been moved inward as indicated by the arrow until valve actuator extensions 36 reach their inward limit of travel within bores 13A, and/or valve actuator stop portion 14B contacts camming means 12B, thereby positioning valve actuator interfering portion 14A out of interference with housing interference portion 12A. Advantageously, due to the engagement of valve actuator mating structure 37 with housing mating structure 39 when valve actuator 14 is moved sufficiently inward into its unlatched position, removal of holding pressure from finger depressible surface 31 will not result in valve actuator 14 slipping back toward its latched position but will maintain the lighter in the unlatched configuration depicted in FIG. 11, until valve actuator 14 is depressed, even though spring means 30 exerts a force on latch 14 tending to bias the latch outward. In other words, the lighter may be readied for actuation and flame production by applying suitable force to finger depressible surface 31 of valve actuator 14 to move valve actuator 14 including interfering portion 14A in an inward direction so as to cause valve actuator mating structure 37 to again engage housing mating structure 39 thereby placing valve actuator interfering portion 14A out of interference with housing interfering portion 12A.

More specifically, when in the unlatched configuration depicted in FIG. 11, indentation 37B of valve actuator mating structure 37 engage protrusion 39A of housing mating structure 39. Indentation 37A of valve actuator mating structure 37 may optionally engage protrusion 39B of housing mating structure 39. Additionally, camming means 12C is positioned beneath valve actuator mating structure 40B. As will be appreciated, while a gap is depicted between camming means 12C and structure 40B, such a gap is not necessary to proper operation of the invention.

Figure 12:
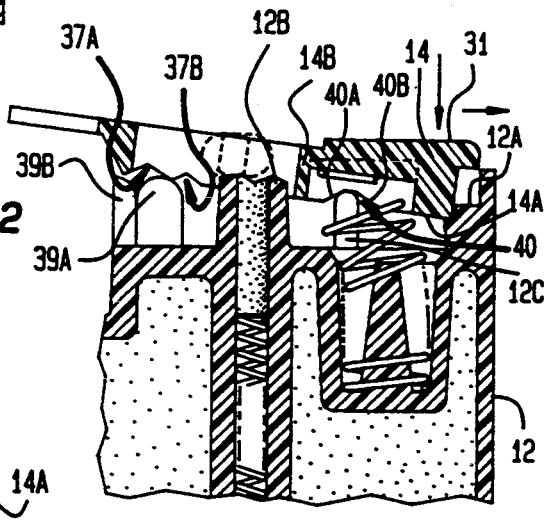
FIG. 12 is a partial cross-sectional view of the lighter of FIG. 11 in its partially unlatched configuration and the valve actuator fully depressed so as to permit the flow of fuel.

Application of suitable downward finger pressure to finger depressible surface 31 of valve actuator 14 as depicted in FIG. 11 will yield the configuration depicted in FIG. 12 in which valve actuator 14 has been depressed thereby permitting fuel to flow through the valve and the fuel nozzle (not shown). In particular, and as more clearly depicted in FIG. 13, such depression of valve actuator 14 will cause compression of spring 30 and urging of fuel nozzle 20 upward and partially out of valve housing 28 and body portion 12. Such lifting of fuel nozzle 20 upward will permit fuel to flow from chamber 15 through the valve and out of nozzle 20 whereupon it will have been ignited by sparks produced by flint 22 and toothed surface 19 of spark-producing assembly wheel 18. Such fuel will continue to flow and burn as long as sufficient pressure is maintained on valve actuator 14. The downward movement of valve actuator 14 is limited by valve actuator interfering portion 14A contacting a portion of housing 12 adjacent to housing interfering portion 12A, as depicted in FIGS. 12 and 13.

Figure 13:
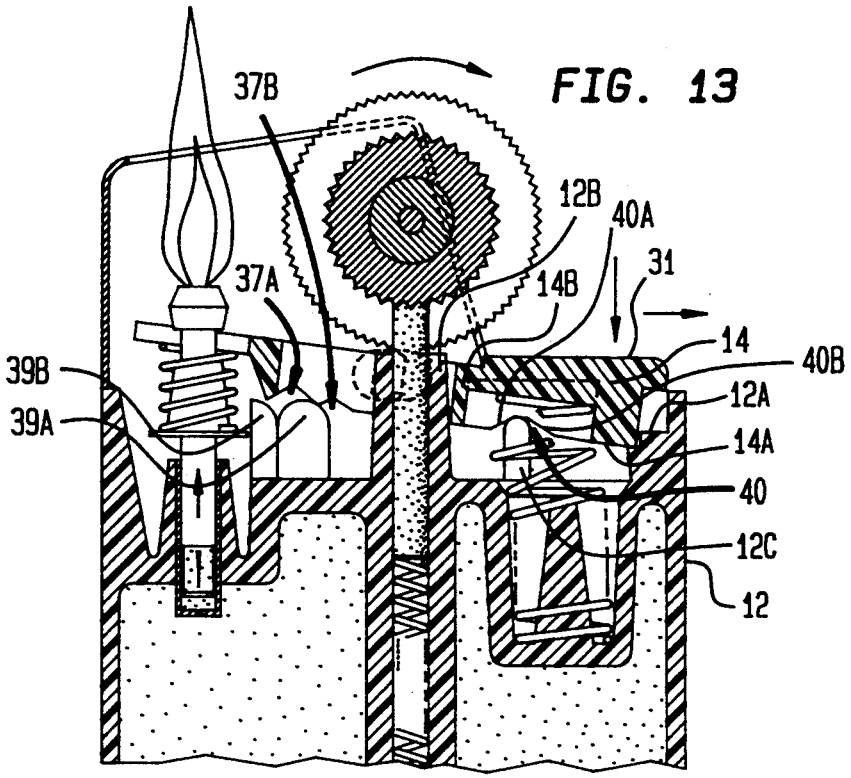
FIG. 13 is a partial cross-sectional view of the lighter of FIG. 12 in greater detail.

As seen in FIGS. 12 and 13, depression of valve actuator surface 31 urges valve actuator 14 downward as well as outward toward its latched position. Such outward movement is due to the contact between valve actuator stop portion 14B and camming means 12B as the valve actuator is moved downward. Such contact causes valve actuator 14 to move outward a limited distance thereby causing indentation 37B of valve actuator mating structure 37 to disengage from protrusion 39A of housing mating structure 39, and causing indentation 37A of valve actuator mating structure 37 to at least partially engage protrusion 39A of housing mating structure 39, as depicted in FIGS. 12 and 13. Additionally, such movement may optionally cause protrusion 37C of valve actuator mating structure 37 to at least partially engage housing mating structure 39 at a location generally between protrusions 39A and 39B.

Such outward movement is also due to the contact between valve actuator portion 40B and camming means 12C as the valve actuator is moved downward. Such contact causes valve actuator 14 to move outward a limited distance thereby causing valve actuator mating structure 37 to move relative to housing mating structure 39 as described above. Accordingly, the outward movement of valve actuator 14 from its unlatched position (see FIG. 11) to its latched position (see FIGS. 12–14), may generally be considered to be initially due to camming 12B as well as camming means 12C.

As will be appreciated, other portions of the housing such as sidewall portions 13 can be employed to cam other portions of the valve actuator so as to cause the valve actuator to move outward when suitably depressed.

Figure 14:
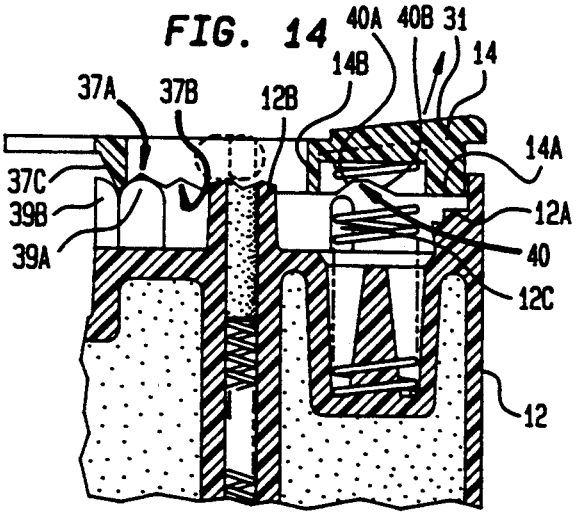
FIG. 14 is a partial cross-sectional view of the lighter of FIG. 12 after the value actuator has been fully depressed and released.

As depicted in FIG. 14, once finger pressure is removed from valve actuator 14, the valve actuator will move upward due to the biasing force provided by spring 30, and the flame will be extinguished. Advantageously, as valve actuator 14 moves upward, it also moves toward its latched position. As described in conjunction with FIGS. 12 and 13, depression of valve actuator 14 causes it to move outward and valve actuator indentation 37B to disengage from housing protrusion 39A. However, even when valve actuator 14 is fully depressed, it is not fully outward and not fully latched. Valve actuator 14 will enter its fully latched position only when the valve actuator is moved fully upward and fully outward.

As will be appreciated, the position of valve actuator mating structure 37 relative to the position of housing mating structure 39 when the valve actuator is fully depressed results in a biasing force which biases the valve actuator outward, and moves the valve actuator outward to its latched position once the valve actuator is released. More specifically, the partial engagement of housing protrusion 39A with valve actuator indentation 37A as depicted in FIGS. 12 and 13 results in a force which biases the valve actuator outward as the valve actuator is moved from its depressed position (FIG. 12) to its latched position (FIG. 14). Additionally, spring 30 as depicted in FIGS. 12 and 13 exerts a biasing force on latch 14 tending to force the latch outward.

While it is apparent that the invention herein disclosed is well-calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the valve actuator and lighter disclosed and claimed herein are not limited to use in disposable lighters. Moreover, the present invention is not limited to a valve actuator which is moved solely in a generally inward direction to an unlatched position. Similarly, the interference experienced by the valve actuator may result from interference portions positioned at other locations.

We claim:

1. A lighter, comprising:

a housing having a longitudinal axis;

a fuel supply within the housing;

a valve assembly which controls flow of fuel from the fuel supply, said valve assembly including a nozzle raisable to release fuel;

ignition means for igniting the flow of fuel from said valve means;

a valve actuator operatively engaging said nozzle to permit the flow of fuel from said valve assembly, said valve actuator being normally positioned to engage the nozzle and prevent raising of the nozzle thus preventing a flow of fuel from the valve assembly and being moveable inward towards the longitudinal axis to a second position to allow the nozzle to be raised and permit flow of fuel from the valve assembly in response to depression of a depressible portion of the valve actuator;

a biasing element disposed between the depressible portion of the valve actuator and the lighter housing and exerting a biasing force on the depressible portion along the longitudinal axis when in the first position and when in the second position.

2. The lighter according to claim 1, wherein:

the valve actuator is pivotally mounted on the lighter housing at slideable pivot point and the biasing element acts on the valve actuator on one side of the pivot point; and the valve actuator includes at least one indentation facing the lighter housing opposite the pivot point from the biasing element, said indentation being biased by the biasing element into engagement with a part of the lighter housing when the valve actuator is in the second position, said engagement tending to maintain the valve actuator in the second position until the depressible portion is depressed by a user.

3. The lighter according to claim 2, comprising a first upright surface on the housing opposing a second upright surface on the valve actuator, said surfaces disposed opposite the pivot point from said at least one indentation and abutting each other when the valve actuator is depressed to force the valve actuator outward to the first position.

4. A lighter comprising:

a housing defining a fuel reservoir, said housing having a longitudinal axis;

valve means for selectively releasing fuel from said fuel reservoir, said valve means including a nozzle raisable along the longitudinal axis to release fuel;

means for igniting the released fuel;

actuator means having a top surface, a bottom surface and an integral nozzle opening at one end for engaging said valve nozzle such that fuel is released when a depressible portion of said actuator means is depressed along the longitudinal axis of said housing, at least a portion of said actuator means disposed above a portion of said housing when in a latched position for preventing said actuator means from being depressed by abutting said portion of said housing, said actuator means being slideably and pivotally mounted within sidewall portions of said housing, wherein inward movement of said depressible portion of said actuator means into an unlatched position aligns said actuator means with a void in said housing, said void being sufficient in size to allow said actuator means to be depressed so as to allow fuel to be released from said fuel reservoir; and camming means operatively engaged with said actuator means when said actuator means is in said unlatched position for moving said actuator means outward away from said longitudinal axis towards the latched position said camming means comprising a sloped wall surface forming a recess in the bottom side of the actuator means and a projection from the lighter housing received in said recess and cooperating with said sloped wall surface to force the actuator means outward to the latched position in response to user applied downward force on the actuator means depressible portion.

5. The lighter according to claim 4 wherein said means for igniting comprises flint material and a rotatable spark-producing wheel having a toothed surface positioned and arranged to selectively frictionally contact said flint material.

6. The lighter according to claim 4 wherein said means for igniting comprises electric spark-producing means.

7. The lighter according to claim 4 wherein said means for igniting comprises piezoelectric spark-producing means.

8. The lighter according to claim 4 wherein said actuator means includes a first mating structure and said housing includes a second mating structure and wherein said second mating structure applies a biasing force to said first mating structure after said depressible portion of said actuator means is depressed, said biasing force biasing said depressible portion of said actuator means outward away from the longitudinal axis of the housing.

9. The lighter according to claim 4 wherein the actuator means engages the valve nozzle in the latched configuration and said lighter comprises a biasing element acting between the housing and the actuator means depressible portion to maintain the valve nozzle in the closed position.

10. A lighter comprising:

a housing having a fuel compartment;

fuel release means for releasing fuel from said fuel compartment;

means for igniting said released fuel;

an actuator including a top side, an underside, a thumb-depressible portion on the top side and an end portion operatively engaging said fuel release means such that when depressed along a longitudinal axis of said housing fuel is released, said actuator having extensions on either sides thereof, and said actuator having a first mating structure on the underside thereof, at least a portion of said actuator disposed above a portion of said housing when in a latched configuration for preventing said actuator from being depressed by abutting said portion of said housing, said extensions of said actuator being slideably and pivotally mounted within bores of sidewall portions of said housing thereby allowing said depressible portion of said actuator both to be pivoted and moved inward towards the longitudinal axis of said housing, wherein inward movement of said depressible portion of said actuator towards the longitudinal axis of said housing and into an unlatched position aligns said depressible portion with a void in said housing sufficient in size to allow said actuator to be depressed, said housing having a second mating structure that engages and mates with said first mating structure for holding said actuator in the unlatched position; and camming means operatively engaging said actuator for displacing said first and second mating structures from each other when said actuator is depressed along the longitudinal axis of said housing so as to apply a biasing force to said actuator moving said actuator into its latched position.

11. The lighter according to claim 10 wherein said means for igniting comprises flint material and a rotatable spark-producing wheel having a toothed surface positioned and arranged to selectively frictionally contact said flint material.

12. The lighter according to claim 10 wherein said means for igniting comprises electric spark-producing means.

13. The lighter according to claim 10 wherein said means for igniting comprises piezoelectric spark-producing means.

14. A lighter normally maintained in a latched configuration comprising:

a housing having a longitudinal axis;

fuel supply means for supplying fuel;

ignition means for igniting said fuel;

valve means for controlling the flow of said fuel;

a valve actuator operatively engaging said valve means to prevent the flow of said fuel when in a first position and permit the flow of fuel when in a second position, said valve actuator having a portion depressible to the second position along the longitudinal axis of said housing, an interfering portion of said valve actuator being disposed above a portion of said housing for normally preventing, when in the latched configuration, said depressible portion of said valve actuator from being depressed into said second position by interfering with the movement thereof along the longitudinal axis of said housing, said valve actuator being slideably and pivotally mounted to said housing, wherein inward movement of said depressible portion of said valve actuator towards the longitudinal axis of said housing enables the interfering portion to become aligned with a cavity in said housing, and places said lighter in an unlatched configuration, said cavity being sufficient in size to accommodate said interfering portion so as to enable said depressible portion of said valve actuator to be depressed; and camming means operatively engaging said valve actuator for forcing said depressible portion of said valve actuator outward away from said longitudinal axis into its first position and the lighter out of its unlatched configuration when said depressible portion of said valve actuator is depressed.

15. The lighter according to claim 14 wherein said ignition means comprises flint material and a rotatable spark-producing wheel having a toothed surface positioned and arranged to selectively frictionally contact said flint material.

16. The lighter according to claim 14 wherein said ignition means comprises electric spark-producing means.

17. The lighter according to claim 14 wherein said ignition means comprises piezoelectric spark-producing means.

18. The lighter according to claim 14 wherein said valve actuator includes a first mating structure and said housing includes a second mating structure and wherein said second mating structure applies a biasing force to said first mating structure after said valve actuator is depressed, said biasing force biasing said depressible portion of said valve actuator outward away from the longitudinal axis of the housing.

19. The lighter according to claim 14, wherein said camming means comprises a first upright surface on the housing opposing a second upright surface on the valve actuator, said surfaces abutting each other when the valve actuator is depressed to force the valve actuator outward.

20. The lighter according to claim 19, further comprising a biasing element acting between the housing and the valve actuator means depressible portion to maintain the valve means in the first position and prevent the flow of fuel.

21. The lighter according to claim 20, wherein said valve actuator includes a mating structure which cooperates with a projection of the housing to maintain the valve actuator in the second position, said mating structure being disposed opposite said biasing element such that the biasing element forces the mating structure into contact with the projection.

22. The lighter according to claim 21, wherein the biasing element is deflected inward due to inward movement of the valve actuator and applies an outward biasing force to the valve actuator.

* * * * *